United States Patent [19]

Shaw

[11] Patent Number: 4,819,576

[45] Date of Patent: Apr. 11, 1989

[54] HYDROFOIL - SUBMARINE VESSEL SYSTEM

[76] Inventor: Chung-Chen C. Shaw, 1626 Belle View Blvd., Alexandria, Va. 22307

[21] Appl. No.: 146,103

[22] Filed: Jan. 20, 1988

[51] Int. Cl.[4] ..... B63B 1/24

[52] U.S. Cl. ..... 114/248; 114/57; 114/274; 114/312

[58] Field of Search ..... 114/312, 313, 322, 337, 114/339, 258, 271, 274, 280, 282, 56, 59, 61, 66, 256, 248, 249

[56] References Cited

U.S. PATENT DOCUMENTS 3,590,765 7/1971 De Lizasoain ..... 114/275
3,648,635 3/1972 Hashemi ..... 114/248

FOREIGN PATENT DOCUMENTS 931575 5/1982 U.S.S.R. ..... 114/256

*Primary Examiner*—Joseph F. Peters, Jr.

*Assistant Examiner*—Jesûs D. Sotelo

[57] ABSTRACT

A high speed vessel system comprises a surface-craft, a sub-craft, a pair of main foils, at least a pair of auxiliary foils, a narrow strut connecting the sub-craft with the surface-craft. The main propeller and main rudder are located at the stern end of the sub-craft hull. When the vessel system is cruising at a high speed, the surface-craft will be lifted above the water line mainly by the buoyant force of sub-craft hull. The foils will control rolling and pitching of the vessel system. The surface-craft and sub-craft will be connected by a separable ball joint (first embodiment) or a plurality of rotatable links (second embodiment) when the vessel system is in sea operation. The sub-craft can be raised up to the water surface level to minimize the draught of the vessel system when the system is resting in a harbor. The present vessel system is specifically designed for a sea going vessel of big size and large tonnage, which needs to cruise at high speed constantly.

3 Claims, 5 Drawing Sheets

FIG 8
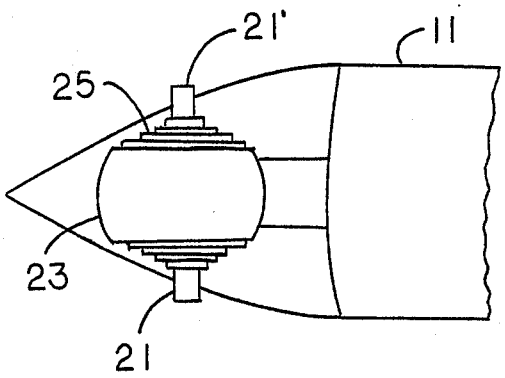
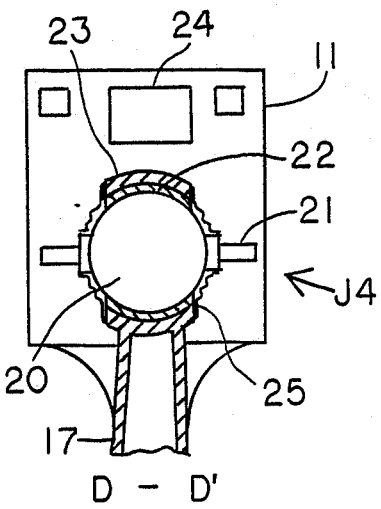
FIG 10
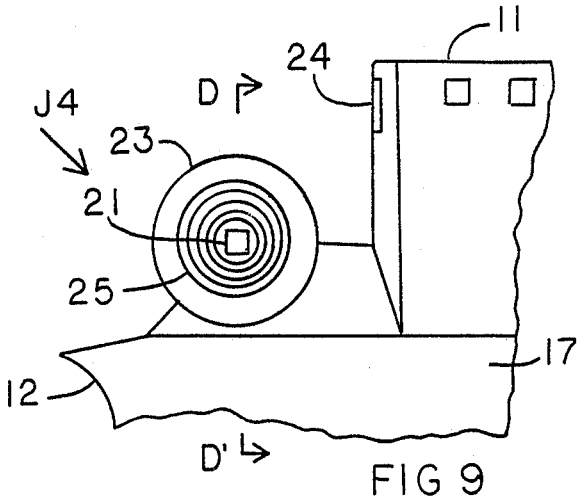
FIG 9
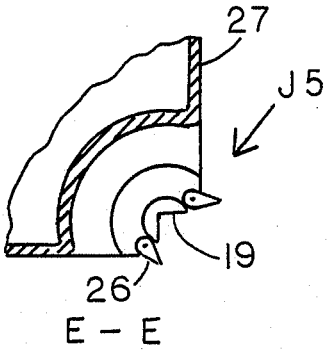
FIG 12
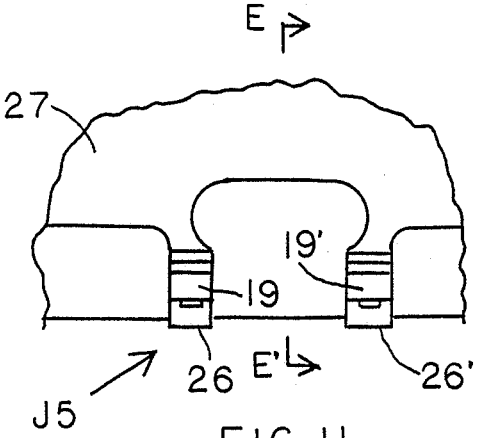
FIG 11

G-G'

HYDROFOIL - SUBMARINE VESSEL SYSTEM

BACKGROUND OF THE INVENTION

It is well known in naval architecture that the tonnage of hydrofoil type craft is limited currently to about 400 tons, because the weight increase of a hydrofoil craft is much faster than the lifting force from foils when the dimensions of the vessel are increased. The tonnage increases cubically by its dimensions while the lifting force from the foils increases squarely by its dimensions.

It is also well known that the power transmission system on retractable foil type hydrofoil craft is very complicated and often causes maintenance and operational problems resulting from many delicate moving elements enclosed in the movable spidery struts.

It is also well known in naval architecture that it is very inconvenient for a fixed foil type of hydrofoil craft to rest at a limited depth of harbor because the extension of foil planes may hit the bed of the harbor: especially for a large tonnage vessel with long and deep fixed foils.

It is also well known that the speed of a displacement type surface ship is greatly limited by wave formation and resistance resulting from these waves. As the speed of a ship increases its Froude number increases, this number being a relationship dependent upon ship's speed. At Froude numbers of 0.5 and greater, wave resistance increases at a very fast rate. This phenomenon limits the speed of displacement type surface ships to a maximum Froude number of about 1.3.

It is further well known in naval architeture that a submarine operating at a depth below the surface of 3 times the diameter of the hull or greater, experiences a negligibly small wave resistance; nearly all of its resistance being frictional and eddy making resistance. Operation at depths of more than 3 diameters eliminates a crucially important limitation to the speed experienced by all the conventional surface ships, since the wave making resistance of a submarine increases with speed at a much lower rate. Therefore, the top speed of a submerged submarine is potentially much higher than that of the displacement surface ship of the same length and immersed volume.

The objective of this invention is to provide a high speed vessel system having large tonnage as a submarine with the advantage of cruising stability, operational flexibility, simplicity and comfortability as a retractable foil type hydrofoil craft.

SUMMARY OF THE INVENTION

The vessel system presented here consists of a hydrofoil craft attached to the top of a reinforced bridge (strut) of a submarine using a big separable ball joint and flexible gate way. Access means are enclosed in the strut. A pair of big main foils are mounted near to the center of the buoyant force of the submarine.

The hydrofoil craft providing rooms for passenger, crew, control or military equipment. Machinery and fuel are included in the submarine.

At high cruising speed, the hull of the hydrofoil craft can be lifted up above the water line mainly by the buoyant force of the submarine. The foils control the rolling and pitching and provide secondary lifting force for the hydrofoil craft.

For submarine, two big main foils control the rolling of strut and ball joint which supports the hydrofoil craft.

The ball joint sustains only compression force, no bending moment or torque from the hydrofoil craft no matter how the hydrofoil or submarine rolls or pitches, since the ball joint is rotatable in all directions; i.e. it will rotate when it sustains a bending force. Thus it is possible to make the strut so narrow, at the interface of the waterline, that it will greatly minimize the crucial wave making resistance.

This vessel system can be separated into two individual crafts; the submarine can be raised to the water surface for minimizing the draught of the vessel system when the vessel system is cruising on a shallow water way or resting in a shallow harbor.

Another embodiment of the present invention is to use a number of rotatable links, instead of a separable ball joint, to join the upper and lower hulls. All the stabilizing foils, propellers, rudders are mounted on the lower hull. The lower hull can be raised to near water surface to minimize draught by rotating the links upward.

The exact nature of the present invention as well as other objectives and advantages will be apparent from the following specifications and associated drawings.

BRIEF DESCRIPTION OF THE DRAWINGS

FIGS. 1–12 are views of the preferred embodiment and FIGS. 13–18 are views of the second embodiment.

FIG. 1 is a side elevational view of a preferred embodiment of this invention while the vessel system is at high cruising speed. The bow and stern of the surface craft are partially cut to reveal the joint. W.L. indicates the waterline.

FIG. 2 is a bottom view of the vessel system of FIG. 1.

FIG. 3 is a stern view of the vessel system of FIG. 1.

FIG. 4 is an elevational view of the vessel system while the system is separated into two individual crafts, the surface craft S1 and the sub-craft S2.

FIG. 5 is a stern view of the surface craft while she is resting on a harbor with her foils retracted.

FIG. 6 is a stern view of the sub-craft while she is resting on a harbor with big main foils retracted.

FIG. 7 is a detailed side view of the ball joint unit J3 which consists of ball bearing unit J4 and seat unit J5.

FIG. 8 is the top view of FIG. 9.

FIG. 9 is a side view of the ball bearing J4 located on the top of strut 17 of the sub-craft.

FIG. 10 is the D—D′ section view of FIG. 9.

FIG. 11 is the stern view of the joint seat J5, located on the bottom of surface craft.

FIG. 12 is the E—E′ section view of FIG. 11.

FIG. 13 is the side elevational view of the second embodiment of this invention while the vessel system is at high cruising speed. The upper hull S5 is cut along longitudinal axis and the lower hull S6 is also partially cut at strut along longitudinal axis. W.L. indicates the waterline.

FIG. 14 is the top view of FIG. 13.

FIG. 15 is the G—G′ section view of FIG. 13.

FIG. 16 is the F—F′ section view of FIG. 13. W.L.1 indicates the waterline when the system is at low cruising speed. W.L.2 indicates the waterline when the system is at high cruising speed.

FIG. 17 is a partially cut side elevational view of the embodiment in FIG. 13 while the lower hull 36 is raised to near water surface to minimize the draught of the vessel system.

FIG. 18 is a H—H' cut view of FIG. 17.

NAMES AND THE CORRESPONDING REFERENCE NUMBERS AND/OR CHARACTERS

| NO. | NAME/DESCRIPTION |
|---|---|
| | For the preferred embodiment, FIGS. 1-12: |
| S1 | Surface craft |
| S2 | Sub-craft |
| J3 | Ball joint unit |
| J4 | Ball bearing unit |
| J5 | Seat unit |
| 1 and 1' | hull, surface craft |
| 2 | hull, sub-craft |
| 4 | foil, forward |
| 5 and 5' | side foil |
| 6 | V shap cutout |
| 7 and 7' | main foil |
| 8 | diving plane |
| 9 | stern rudder |
| 10 | main propeller |
| 11 | island |
| 12 | V front, strut |
| 13 | mid-rudder |
| 14 and 14' | auxiliary propeller |
| 15 and 15' | auxiliary rudder |
| 16 | flexible gate way (in FIGS. 1, 7) |
| 17 | strut |
| 18 | bridge |
| 19 and 19' | seat |
| 20 | ball |
| 21 | square pivot, ball extention |
| 22 | bronze bushing |
| 23 | housing, bearing |
| 24 | door, flexible gateway |
| 25 | flexible protection, bearing |
| 26 and 26' | clamp |
| 27 | central deck |
| 28 | center of gravity, surface craft |
| 29 and 29' | ballast tank |
| 30 | cables |
| 31 | extension, air inlet duct |
| f | compound force at ball joint unit 13 |
| f1 | pushing force from main propeller 10 |
| f2 | buoyant force of sub-craft s2 |
| 32 | rudder, forward |
| 33 | rudder, side |
| | For the second embodiment, FIGS. 13-18: |
| S5 | Upper craft |
| S6 | Lower craft |
| L7 | Main link |
| L7' | Forward link |
| 51 | upper hull |
| 52 | lower hull |
| 55 | pivot, upper central |
| 56 | pivot, upper forward |
| 57 | pivot, lower central |
| 58 | pivot, lower forward |
| 59 and 59' | main foil |
| 60 and 60' | forward foil |
| 61 | main rudder |
| 62 | forward rudder |
| 63 | propeller |
| 64 | strut |
| 65 | elevator and door |
| 66 | duct, air inlet |
| 67 | exhaust duct |
| 68 | cutout, central |
| 69 | bridge |
| 70 | extension, air inlet |
| 71 and 71' | protection plane |
| 72 | island, central |
| 73 | lock pin |
| 74 | island, forward |
| 75 | upper door |
| 76 | shock absorber (rubber bumper) |
| 77 | fastener |
| 78 and 78' | ballast tank |

-continued

| NO. | NAME/DESCRIPTION |
|---|---|
| 79 | cutout, forward |
| 80 | cables |

DESCRIPTION OF THE PREFERRED EMBODIMENTS

Figure 1:
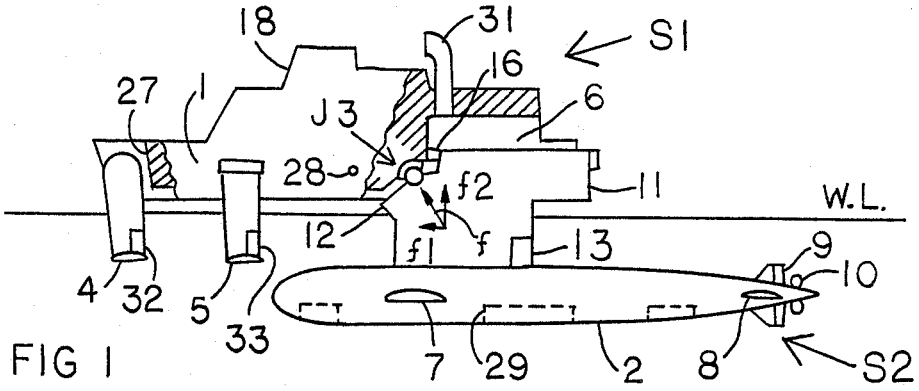
Figure 2:
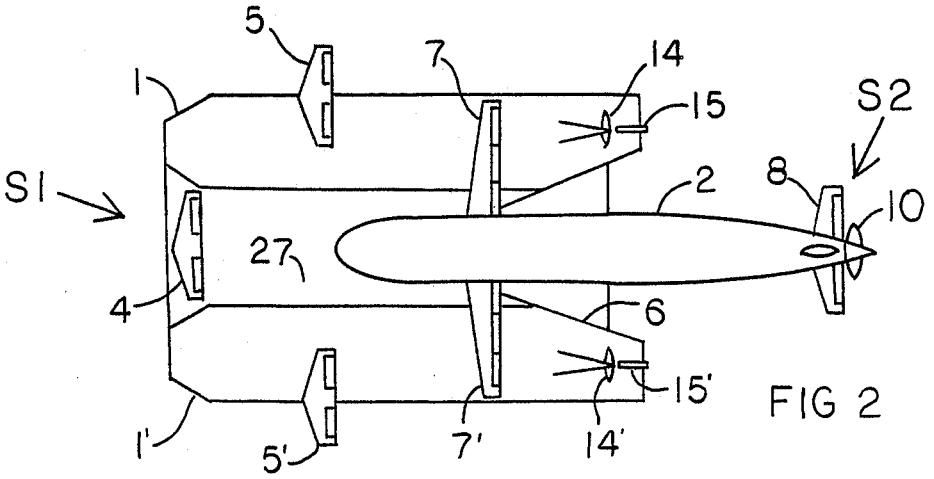
Figure 3:
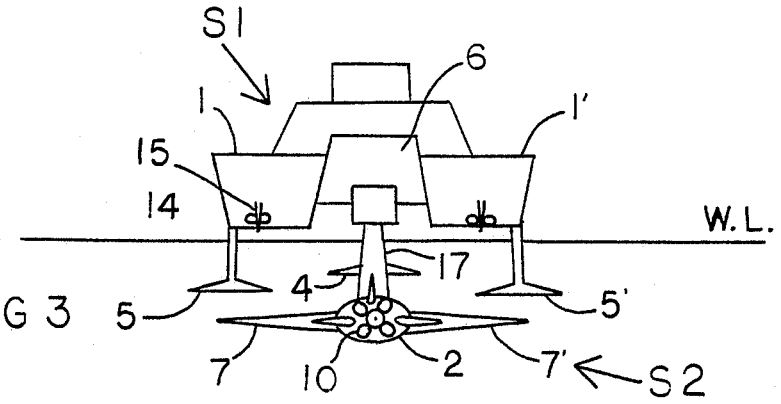

Referring to FIG. 1 which illustrates the preferred embodiment of this invention while cruising at high speed with the surface craft foilborne. A hydrofoil-like surface craft S1 has double hulls 1,1' (ref. FIG. 1 and 2). A central deck 27 is between the two hulls. Forward foil 4 and side foils 5, 5' are retractable-style. Near the center of gravity 28 is the ball joint unit J3, which is a rotatable, separable connection between the surface craft S1 and the sub-craft S2.

Ball joint unit J3 is held at the top of strut 17. The strut 17 is narrow around the waterline to minimize wave resistance. Main propeller 10 generates pushing force at high speed.

In FIG. 1, the surface craft S1 is lifted mainly by the buoyant force f2 of the sub-craft hull 2 (a vertical component force of f) through the ball joint unit J3. The forward foil 4 and side foils 5, 5' control the pitching and rolling motions, respectively, and provide a secondary lifting force to the surface craft S1.

Another component force at ball joint unit J3 is the horizontal force f1 from main propeller 10, which pushes the vessel system, through the sub-craft hull 2 and strut 17 to ball joint unit J3 then surface craft central deck 27. "f" is the sum of forces f1 and f2.

On the sub-craft S2, two big main foils 7, 7' control rolling of sub-craft S1, and more importantly the rolling of strut 17 and ball joint unit J3, which in turn controls the stability of surface craft S1. Main foils 7, 7' also provide 10 to 25% of the vertical component force of f2.

V-Cutout 6 at the bottom of surface craft S1 around ball joint unit J3 and island 11, is the necessary clearance to avoid interference between the surface craft hull 1, 1' and island 11 when the vessel system is making turning or rolling/pitching by wave influence.

Figure 7:
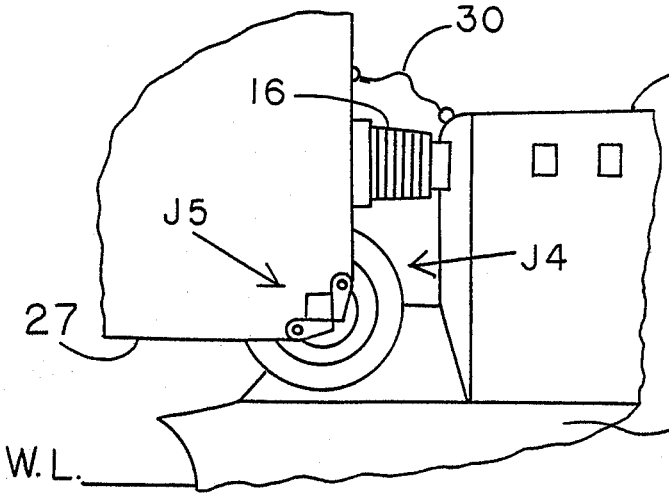

FIG. 7 shows the flexible gate 16 and cables 30 providing the access means for human beings, energy, air and materials between the surface craft S1 and sub-craft S2.

For economical and practical consideration, the surface craft S2 and the island 11 and strut 17 of the sub-craft will be made as light as possible. They will be made of light and strong material such as aluminum alloy or carbon/glass fiber reinforced composite material. The sub-craft hull 2 could be made of economical material such as carbon steel.

All heavy stuffs and equipments such as machinery, fuel and part of military payload can be located and stocked in sub-craft hull 2. Passengers, crew, controls, communication equipments and military payload will be located in the surface craft S1. In order to minimize the wave making resistance by sub-craft S2, the draught of sub-craft hull 2 could be as deep as three times the sphere diameter of the hull 2.

Figure 4:
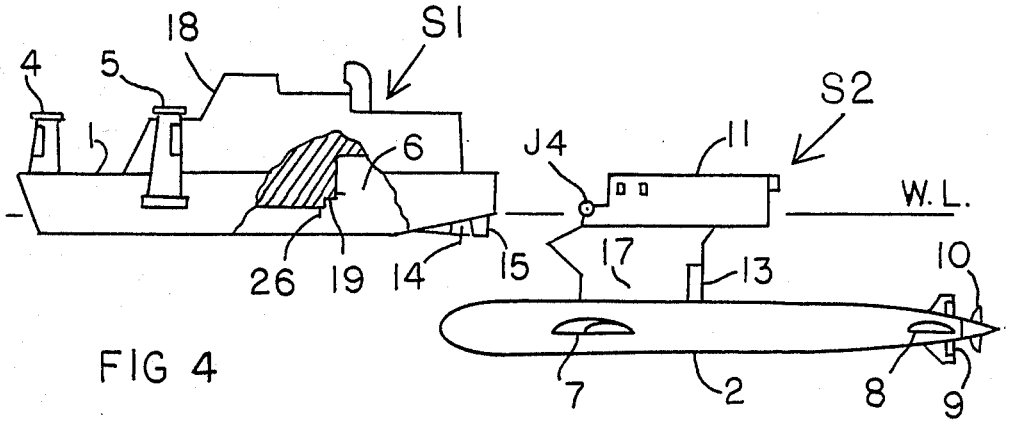
Figure 5:
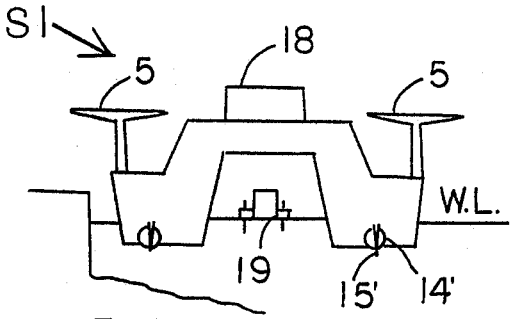
Figure 6:
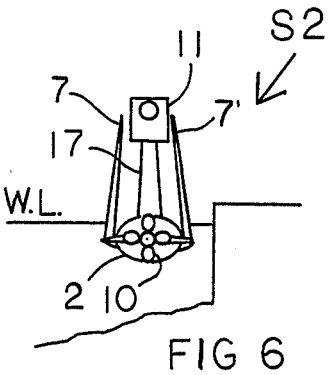

In this embodiment of the invention, the two crafts S1, S2 are separable through the use of ball joint unit J3 (see FIG. 4, 8, 9, 10, 11 and 12). This important feature is new and useful. It makes the present invention effective for the vessel system to rest in a shallow harbor (see FIG. 4, 5 and 6). In FIG. 4 the vessel system is separated into two individual crafts S1 and S2 by opening clamps 26, while the foils 4 and 5 of the surface craft S1 are retracted to minimize drag resistance and using her own comparatively small auxiliary propellers 14, 14' and rudders 15, 15'. In FIG. 5 she rests in a harbor with all foils 4, 5, 5' retracted. The sub-craft S2 in FIG. 4 has her own control system, using island 11 as bridge. FIG. 6 shows the sub-craft S2 raised to water surface and rested in a harbor with two big main foils 7, 7' retracted.

FIGS. 7–12 show the detail of ball joint unit J3. The ball joint unit J3 consists of ball bearing unit J4, located at the top of strut 17 of sub-craft S2, and seat unit J5, located at the bottom of central deck 27 of surface craft S1. FIG. 9 shows the side view of ball bearing unit J4, with top view in FIG. 8 and D—D' section view in FIG. 10. The shell style big ball 20, with square cross section extension 21 on both sides, will be used to connect with seat 19, 19' and clamp 26, 26' (refer to FIGS. 7, 11 and 12) of seat unit J5. Bushing 22 works as bearing. Bearing housing 23 holds the ball 20 and bushing 22. The flexible protection 25 is waterproof to protect ball bearing unit J4 from sea water contamination. Door 24 shown in FIGS. 9 and 10 is the exit to surface craft S1 when the two crafts are connected. FIG. 11 is the stern view of seat unit J5. Two seats 19, 19' are symmetric with respect to the vertical center line E—E' of surface craft S1, with a pair of clamps 26 at each joint seat for holding the extensions 21, 21' at ball bearing unit J4 when the system is connected (see FIG. 7). The control of clamp 26 could be mechanical or hydraulical.

Another important and useful new feature is that the ball 20 of ball joint unit J3 can turn freely in any direction. This makes ball joint unit J3 free of bending moment, no matter how the surface craft S1 and sub-craft S2 are rolling, pitching or turning. Since the ball joint unit J3 sustains only direct compression force "f" (FIG. 1) from two crafts, it is possible in the present invention to build the strut 17 much narrower compared to the sub-craft hull 2, for minimizing wave making resistance.

Figure 13:
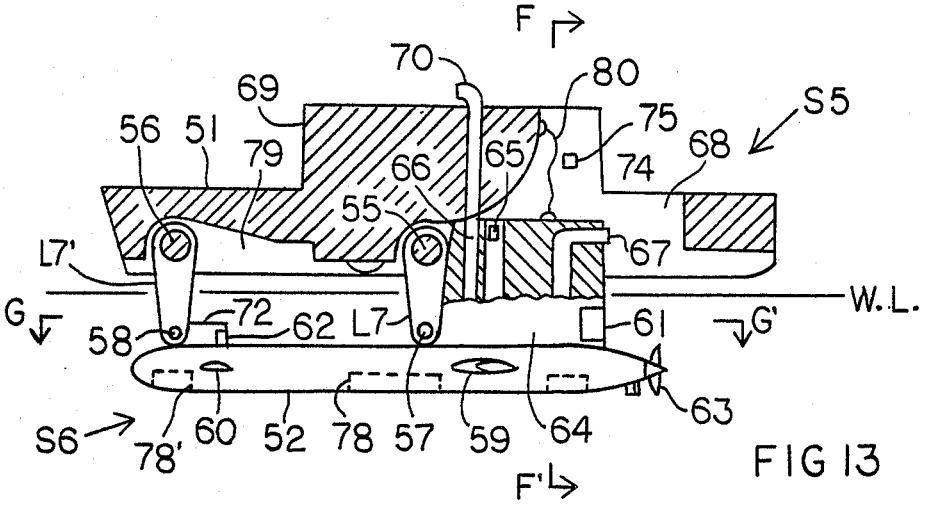

FIG. 13 through FIG. 18 show another embodiment of this invention. It contains uppercraft S5, lowercraft S6, links L7, L7', strut 64. FIG. 13 shows the vessel system at high cruising speed with the upper craft being lifted up by the buoyant force of lower hull 52, and by the dynamic force of main foils 59. The forward foils 60 and main foils 59 control pitching motion. Two big main foils 59 control rolling motion. The main rudder 61 and forward rudder 62 control turning. The elevator 65, air inlet duct 66, exhaust duct 67 and cable 80 are enclosed in strut 64. Machinery, fuel and all heavy stuffs are to be located or stocked in lower craft S6. Military payload, living quarters, control and communication will be located in upper craft S5. Like the previous embodiment, the upper craft S5 and strut 64 will be made of light and strong material. The lower craft S6 could be made of carbon steel.

Figure 14:
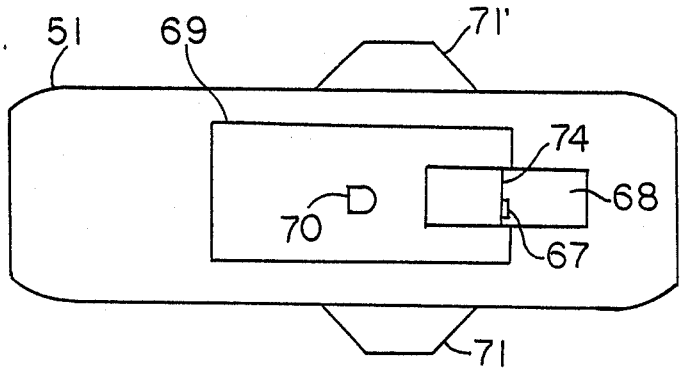

The function of protection planes 71 shown on FIG. 14 is to protect the two big fixed main foils 59, 59'.

Figure 15:
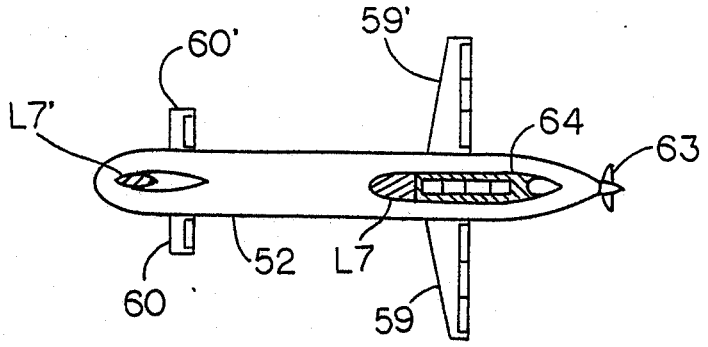

FIG. 15 is the G—G' section view of FIG. 13. It shows the air plane-like configuration of lower craft S6. The manipulation characteristics of this embodiment resembles those of an air plane. The cutout 68 and 79 in upper craft S5 provide the necessary clearance for the lower craft S6 to be raised to the water surface.

Figure 16:
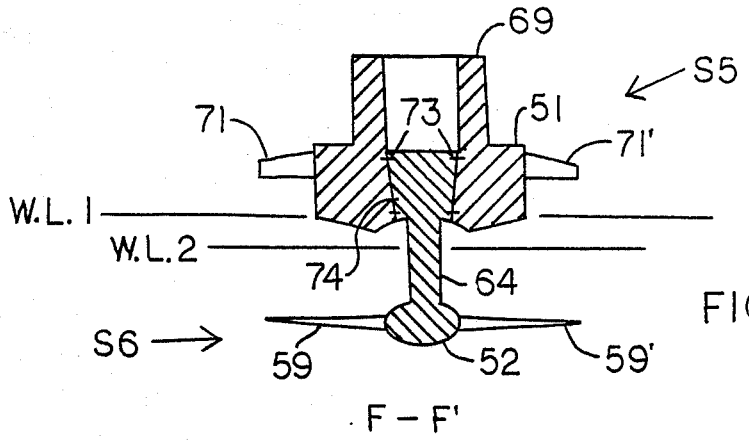

FIG. 16 shows the island 74 on the top of strut 64, which can be locked by lock pins 73 to insure the rigidity of the vessel system. W.L.1 shows the waterline when the system is at low speed and W.L.2 the waterline when the system is at high cruising speed.

Figure 17:
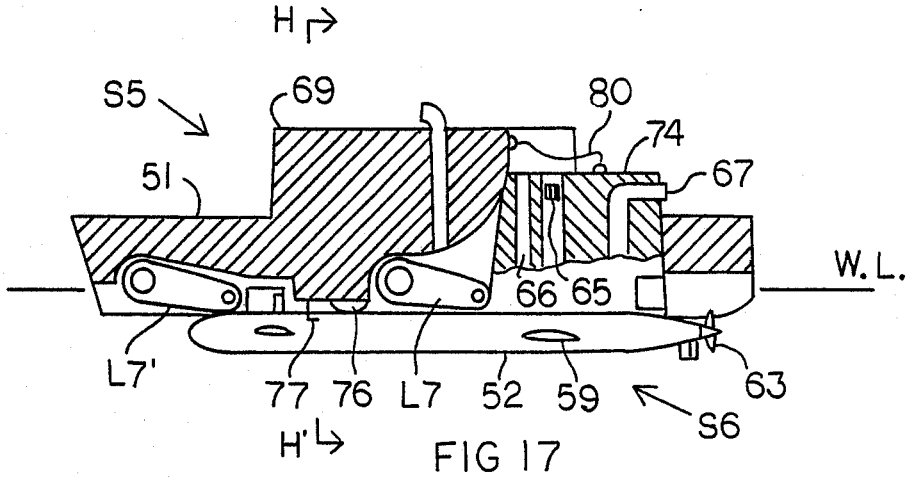

FIG. 17 shows an important and useful new feature of this invention. The links L7, L7' can rotate about 90 degrees to raise lowercraft S6 up to the water surface to minimize the draught, when the vessel system is at low speed or resting on a shallow harbor.

Figure 18:
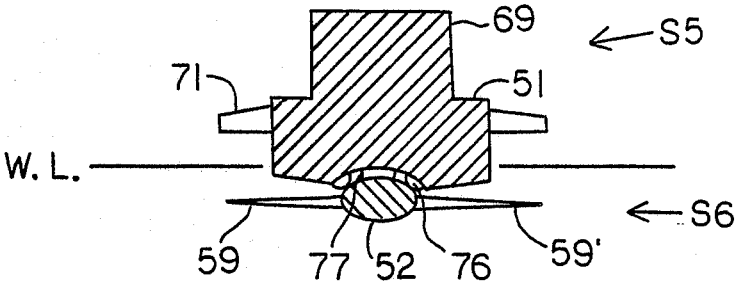

When the lower craft is rising, the compressed air in rubber bumper 76 shown in FIGS. 17 and 18 release slowly until the solid portions of the two hulls 51 and 52 touch, and then the fastener 77 would lock the two hulls 51, 52 and island 73 firmly. Note the elevator door 65 at island 74 of lower craft S6 in FIG. 17, now is reaching to the upper door 75 of upper craft S5 shown in FIG. 13.

The advantages and characteristics of this invention can be summarized below:

1. Larger tonnage: The sustaining force for surface/upper craft of this invention is mainly from the buoyant force of sub/lower craft hull rather than the dynamic force of foils, when the vessel system is cruising at high speed, so the tonnage of present vessel systems could be built much larger than conventional hydrofoil craft.
2. High cruising speed with fuel efficiency: Most of wet areas (the foils and sub/lower craft) of the present invention are submerged deeply under the water surface resulting in low wave making resistance when the vessel system is at high cruising speed.
3. Efficient in port: The sub/lower craft could be raised up to water surface to minimize the draught, making the present vessel system convenient to rest on a harbor or base.
4. Simple, rugged power transmission: The propeller is located at the stern end of the sub/lower craft where the power plant and transmission gears are enclosed.

I claim:

1. A hydrofoil-submarine hybrid vessel system comprising:

a. a surface craft for housing passenger, crew, control systems and military load;
b. at least one foil mounted at the bottom of said surface craft for controlling roll and pitch of said surface craft, and providing some lifting force when said vessel system is at high cruising speed;
c. a sub-craft for machinery, fuel, ballast, heavy stuff storage and military load;
d. a strut mounted on top of the said subcraft, access means enclosed in the said strut;
e. one pair of main foils are mounted symmetrically on both sides of the sub-craft to provide stabilizing and lifting force when said vessel system is at high cruising speed;
f. propulsion means, diving planes and rudders are mounted on the said sub-craft;
g. a separable joint means for connecting the surface craft and the sub-craft, having three degrees of rotating freedom, is mounted at the top of the strut of the said sub-craft and the bottom of the said surface craft;
h. a V-shape cutout is provided at the bottom of the said surface craft and around the top of said strut of the said sub-craft; and
i. auxiliary propulsion and steering means are mounted on said surface craft to provide a force for moving the surface craft when the surface craft is separated from the sub-craft.

2. Marine joint apparatus as defined in item "g" of the claim 1 wherein said separable joint means include:

a. a ball bearing unit with connecting extensions mounted at the top of the strut of the said sub-craft;

b. a seat unit with holding clamps mounted at the bottom of the said surface craft.

3. A hydrofoil-submarine hybrid vessel system comprising:

a. an upper hull for crew, control systems, military load and housing passengers;

b. a lower hull for machinery, fuel, ballasting, storage and military load;

c. a pair of main foils mounted symmetrically on both sides of the said lower hull to provide stabilizing and lifting force when said vessel system is at high cruising speed;

d. at least one pair of auxiliary foils mounted on the said lower hull to control the pitch of the said vessel system;

e. propulsion means and rudders mounted on the said lower hull;

f. at least one strut with access means mounted on the top of the said lower hull;

g. said lower hull mounted at the bottom of the said upper hull by using a plurality of links and pivots, symmetrically arranged along the longitudinal axis of the said vessel system, in which the said links are rotatable along the longitudinal direction of the said vessel system, for raising up or lowering down the said lower hull.

* * * * *